US012606392B2

(12) United States Patent
Ishii

(10) Patent No.: US 12,606,392 B2
(45) Date of Patent: Apr. 21, 2026

(54) SHEET FEEDING DEVICE AND IMAGE FORMING APPARATUS INCLUDING THE SAME

(71) Applicant: KYOCERA Document Solutions Inc., Osaka (JP)

(72) Inventor: Akira Ishii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 47 days.

(21) Appl. No.: 18/785,330

(22) Filed: Jul. 26, 2024

(65) Prior Publication Data

US 2025/0042680 A1 Feb. 6, 2025

(30) Foreign Application Priority Data

Aug. 2, 2023 (JP) ..... 2023-126327

(51) Int. Cl.
*B65H 1/26* (2006.01)

(52) U.S. Cl.
CPC ..... *B65H 1/266* (2013.01); *B65H 2401/11* (2013.01); *B65H 2401/15* (2013.01); *B65H 2402/30* (2013.01); *B65H 2404/152* (2013.01); *B65H 2405/111* (2013.01); *B65H 2405/114* (2013.01)

(58) Field of Classification Search
CPC .... B65H 1/266; B65H 3/5215; B65H 3/5261; B65H 2401/11; B65H 2401/111; B65H 2401/15; B65H 2402/30; B65H 2404/152; B65H 2404/1521; B65H 2405/111; B65H 2405/112; B65H 2405/113; B65H 2405/114
See application file for complete search history.

(56) References Cited

U.S. PATENT DOCUMENTS

| | | | | |
|---|---|---|---|---|
| 9,764,912 | B1 * | 9/2017 | McFarland | B65H 1/266 |
| 2011/0318079 | A1 * | 12/2011 | Sakamoto | B65H 1/266 271/145 |
| 2017/0277103 | A1 * | 9/2017 | Maeda | G03G 15/6502 |
| 2019/0077619 | A1 * | 3/2019 | Umezawa | G03G 15/6502 |
| 2019/0077621 | A1 * | 3/2019 | Kato | B65H 3/5261 |
| 2019/0233227 | A1 * | 8/2019 | Sato | B65H 1/266 |

FOREIGN PATENT DOCUMENTS

JP 2019-131359 A 8/2019

* cited by examiner

*Primary Examiner* — Prasad V Gokhale
(74) *Attorney, Agent, or Firm* — Stein IP, LLC

(57) ABSTRACT

Provided is a sheet feeding device including: a cassette housing section; a sheet storage cassette; and a sheet feeding unit. The sheet storage cassette includes a cassette base which is configured to store recording media that have a sheet form, and can be inserted into and removed from the cassette housing section. The sheet feeding unit is provided in the cassette housing section, and is configured to feed the recording media to be stored in the sheet storage cassette. A pair of fixed-side rails that are made of metal and are attached to the cassette housing section. The cassette base is made of a resin. A pair of inner rails that are coupled to the pair of fixed-side rails so that the pair of inner rails are slidable are formed integrally with side surfaces of the cassette base.

5 Claims, 5 Drawing Sheets

SHEET FEEDING DEVICE AND IMAGE FORMING APPARATUS INCLUDING THE SAME

INCORPORATION BY REFERENCE

This application is based on and claims the benefit of priority from Japanese Patent Application No. 2023-126327 filed on Aug. 2, 2023, the contents of which are hereby incorporated by reference.

BACKGROUND

The present disclosure relates to a sheet feeding device including a sheet storage cassette with a cassette base in which sheet-like recording media are stacked and stored. The present disclosure also relates to an image forming apparatus including the sheet feeding device.

In the image forming apparatus such as a copying machine, a printer, or a facsimile machine, the sheet storage cassette in which sheets (paper) of various sizes can be stacked as appropriate is provided in a manner that can be inserted into and removed from a main body of the image forming apparatus.

The sheet storage cassette is set into a cassette housing section in the main body of the image forming apparatus in a manner that can be inserted into and drawn out of the cassette housing section through intermediation of slide rails each including an outer rail that is provided on a side where the main body of the image forming apparatus is present, and an inner rail that is provided on a side where the sheet storage cassette is present.

In many cases, the sheet storage cassette is molded from a resin, and hence has a problem that a bottom portion of the cassette is warped by a load of the paper onto the bottom portion of the cassette to cause side surfaces of the cassette to sag inward. If the side surfaces of the cassette sag inward, positional accuracy between the sheet storage cassette and the slide rails decreases to make it impossible to reliably position the sheet storage cassette that has been inserted in the main body of the image forming apparatus. Thus, there is a risk of occurrence of skews of the paper and paper-feed failures such as a misfeed. In recent years, in order that large-size paper of sizes exceeding the A3 size is handled, the sheet storage cassette itself is being enlarged. Thus, the paper that can be stored in the sheet storage cassette has become heavier, and the sag of the side surfaces of the cassette has become more conspicuous.

SUMMARY

According to an aspect of the present disclosure, there is provided a sheet feeding device including: a cassette housing section; a sheet storage cassette; and a sheet feeding unit. The sheet storage cassette includes a cassette base which is configured to store recording media that have a sheet form, and can be inserted into and removed from the cassette housing section. The sheet feeding unit is provided in the cassette housing section, and is configured to feed the recording media to be stored in the sheet storage cassette. A pair of fixed-side rails that are made of metal and are attached to the cassette housing section. The cassette base is made of a resin. A pair of inner rails that are coupled to the pair of fixed-side rails so that the pair of inner rails are slidable are formed integrally with side surfaces of the cassette base.

DETAILED DESCRIPTION

Figure 1:
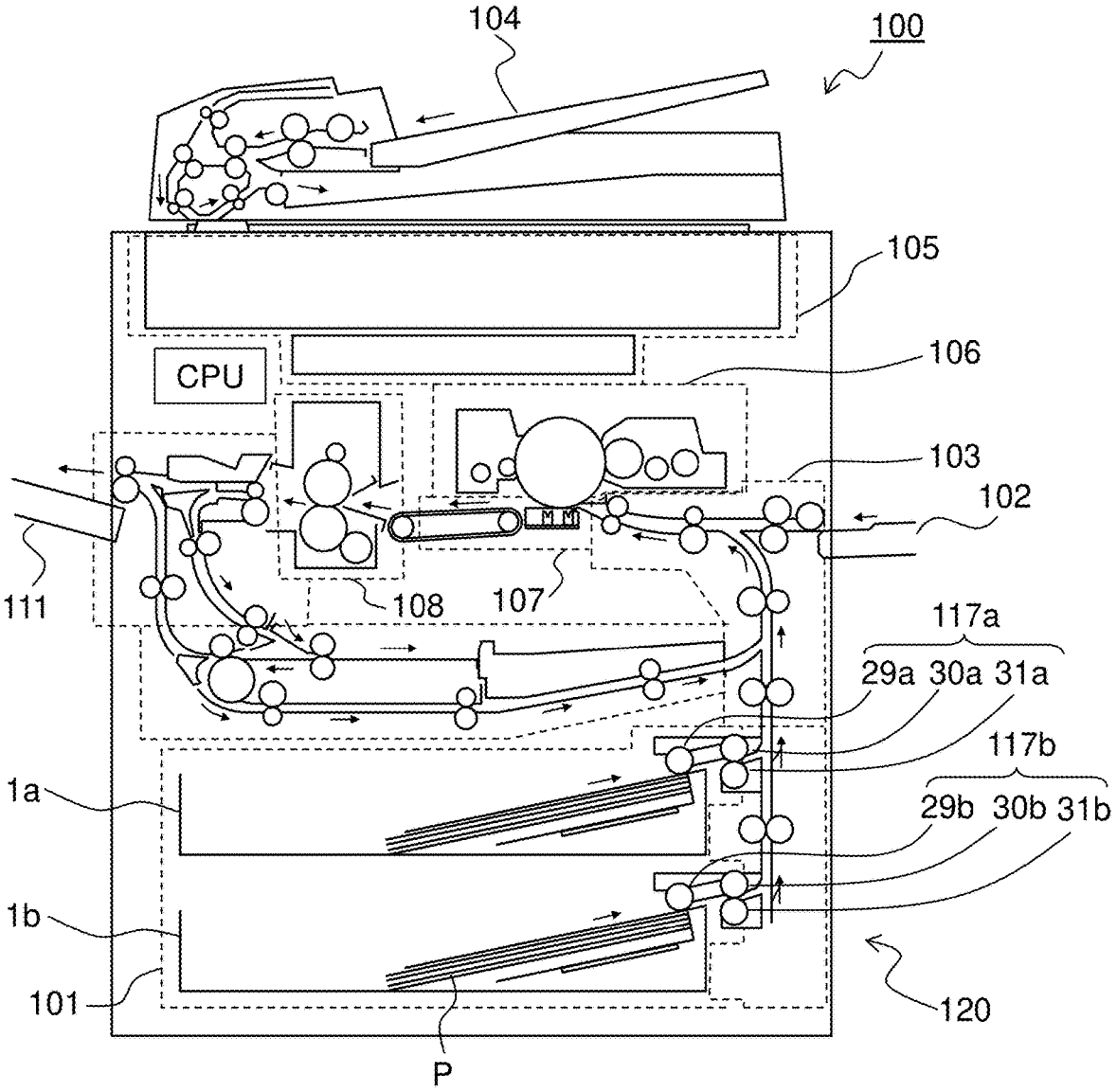
FIG. 1 is a schematic cross-sectional view illustrating an internal structure of an image forming apparatus including a sheet feeding device according to an embodiment of the present disclosure.

In the following, an embodiment of the present disclosure is described with reference to the drawings. FIG. 1 is a schematic cross-sectional view illustrating an internal structure of an image forming apparatus 100 including a sheet feeding device 120 according to the embodiment of the present disclosure. Note that, solid arrows in FIG. 1 indicate a conveying path and a conveying direction of paper P.

In FIG. 1, a cassette housing section 101 is arranged on a lower side in the image forming apparatus 100. The cassette housing section 101 includes two paper feeding cassettes 1*a* and 1*b*. Bundles of the paper P such as cut paper before printing are stacked and stored in the paper feeding cassettes 1*a* and 1*b*. Pieces of the paper P are separated and fed out one by one of the bundles of the paper P by paper feeding units 117*a* and 117*b* provided in a main body of the image forming apparatus 100. The cassette housing section 101, the paper feeding cassettes 1*a* and 1*b*, and the paper feeding units 117*a* and 117*b* constitute the sheet feeding device 120.

The paper feeding unit 117*a* includes a pick-up roller 29*a*, a feed roller 30*a*, and a retard roller 31*a* that is held in press-contact with the feed roller 30*a*, the rollers being provided to correspond to the paper feeding cassette 1*a*. The paper feeding unit 117*b* includes a pick-up roller 29*b*, a feed roller 30*b*, and a retard roller 31*b* that is held in press-contact with the feed roller 30*b*, the rollers being provided to correspond to the paper feeding cassette 1*b*.

A manual paper-feeding section 102 is provided to an outside of an upper side of a right-hand side surface of the image forming apparatus 100. Paper that is different in size and thickness from that in the cassette housing section 101, and paper that is fed one by one, such as overhead transparencies, envelopes, postcards, and invoices, are set on the manual paper-feeding section 102.

A paper conveying section 103 is arranged in the image forming apparatus 100. The paper conveying section 103 is located on the right relative to the cassette housing section 101, that is, on a downstream side in the paper feeding direction relative to the cassette housing section 101, and is located on the left relative to the manual paper-feeding section 102, that is, on a downstream side in the paper feeding direction relative to the manual paper-feeding section 102. The paper P that has been fed out of the cassette housing section 101 is conveyed vertically upward along the side surface of the main body of the image forming apparatus 100 by the paper conveying section 103. The paper P that has been fed out of the manual paper-feeding section 102 is horizontally conveyed.

On a top surface of the image forming apparatus 100, an auto document feeder 104 for conveying originals is arranged, and an image reading section 105 is arranged under the auto document feeder 104. At a time of copying a plurality of originals, these originals are stacked in the auto document feeder 104. In the auto document feeder 104, the originals are separated and fed out one by one, and then their image data is read by the image reading section 105.

An image forming section 106 and a transfer section 107 are arranged on a downstream side in the paper conveying direction relative to the paper conveying section 103, that is, under the image reading section 105. In the image forming section 106, electrostatic latent images of images of the originals are formed on the basis of the image data read by the image reading section 105, and these electrostatic latent images are developed into toner images. Meanwhile, in synchronization with timings when the toner images are formed in the image forming section 106, the paper P is conveyed from the cassette housing section 101 to the transfer section 107 via the paper conveying section 103. The toner images formed in the image forming section 106 are transferred onto the paper P in the transfer section 107.

A fixing section 108 is arranged on a downstream side relative to the transfer section 107. The paper P on which the toner images have been transferred in the transfer section 107 is conveyed to the fixing section 108, and passes through a nip portion formed of a fixing roller pair including a heating roller and a pressure roller. With this, the toner images on the paper P are fixed to be permanent images. The paper P that has been discharged from the fixing section 108 is discharged onto a paper discharge tray 111 provided on an outside of a left-hand side surface of the image forming apparatus 100.

Figure 2:
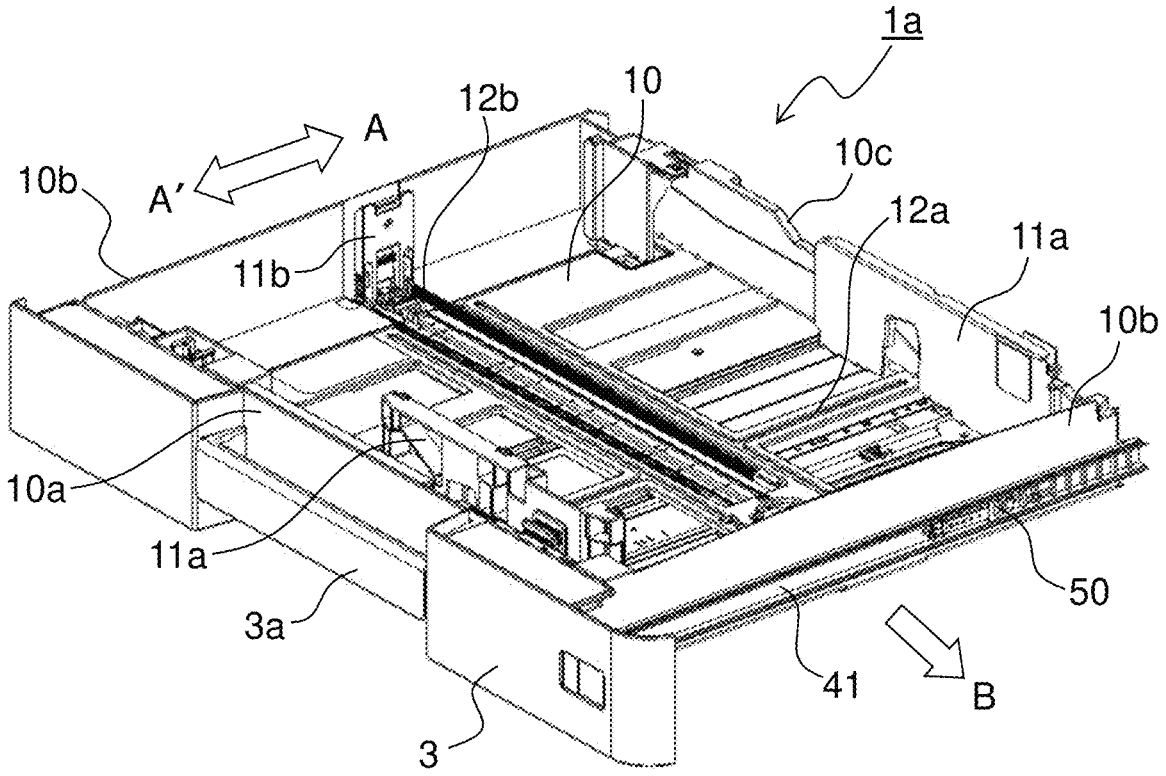
FIG. 2 is an external perspective view in which a paper feeding cassette is viewed from above.

Next, details of a configuration of the paper feeding cassette 1*a* that can be inserted into and removed from the image forming apparatus 100 are described. FIG. 2 is an external perspective view in which the paper feeding cassette 1*a* is viewed from above on the front side. Note that, only the configuration of the paper feeding cassette 1*a* is described herein because the paper feeding cassette 1*b* also has exactly the same configuration. In addition, in FIG. 2, a direction in which the paper feeding cassette 1*a* is inserted into the cassette housing section 101 is indicated by an arrow A, a direction in which the paper feeding cassette 1*a* is drawn out is indicated by an arrow A', and a direction in which the paper P is fed out of the paper feeding cassette 1*a* is indicated by an arrow B.

The paper feeding cassette 1*a* is housed in the cassette housing section 101 of the image forming apparatus 100 illustrated in FIG. 1. A cassette base 10 being a main-body portion of the paper feeding cassette 1*a* is obtained by forming a resin into a shape of a box having an opened upper side, and stores the paper P that is stacked from this upper side. In the cassette housing section 101 in the image forming apparatus 100, the paper feeding unit 117*a* (refer to FIG. 1) is provided above the paper feeding cassette 1*a*, and the paper P (refer to FIG. 1) is fed in the direction of the arrow B shown in FIG. 2. A cassette cover 3 is fitted to a side surface 10*a* on the front side of the cassette base 10. A front surface side (left-hand front side in FIG. 2) of the cassette cover 3 is exposed to the outside. With this, the cassette cover 3 constitutes a part of an outer surface of the main body of the image forming apparatus 100. A grip portion 3*a* to be gripped at the time when the paper feeding cassette 1*a* is inserted into and removed from the cassette housing section 101 is provided to the cassette cover 3.

An inner rail 41 is provided on an outside of each of a pair of side surfaces 10*b* of the cassette base 10, the side surfaces 10*b* being parallel to the insertion direction and the removal direction (directions of the arrows A-A'). The inner rail 41 is made of a resin, and is formed integrally with the cassette base 10. The inner rail 41 is formed at a position that is closer to a lower end portion of the side surface 10*b* (bottom surface of the cassette base 10) than to an upper end portion of the side surface 10*b* (opening of the cassette base 10) in upper-and-lower directions of the side surface 10*b*.

The inner rail 41 is engaged with a middle rail 43 (refer to FIG. 6) provided to the cassette housing section 101, and the paper feeding cassette 1*a* is horizontally slid in the direction of the arrow A shown in FIG. 2. In this way, the paper feeding cassette 1*a* is inserted into the cassette housing section 101.

In the cassette base 10, there are provided a paper stacking plate (not shown) on which the paper P is stacked, a pair of width regulating cursors 11*a* that perform positioning in a width direction of the paper P to be stacked on the paper stacking plate, and a trailing-edge cursor 11*b* that come to positions in accordance with sizes of the paper P and align trailing edges of the paper P stacked on the paper stacking plate.

The paper P is fed out in the direction of the arrow B toward the paper conveying section 103 (refer to FIG. 1). Thus, the pair of width regulating cursors 11*a* that perform the positioning in the width direction of the paper P are provided to be reciprocal along cursor guide grooves 12*a* formed in the cassette base 10 and reciprocal in directions (the directions of the arrows A-A') that are orthogonal to the paper feeding direction. In addition, the trailing-edge cursor 11*b* that aligns the trailing edges of the paper P is provided to be reciprocal along a cursor guide groove 12*b* formed in the cassette base 10 and parallel to the paper feeding direction (the direction of the arrow B).

Figure 3:
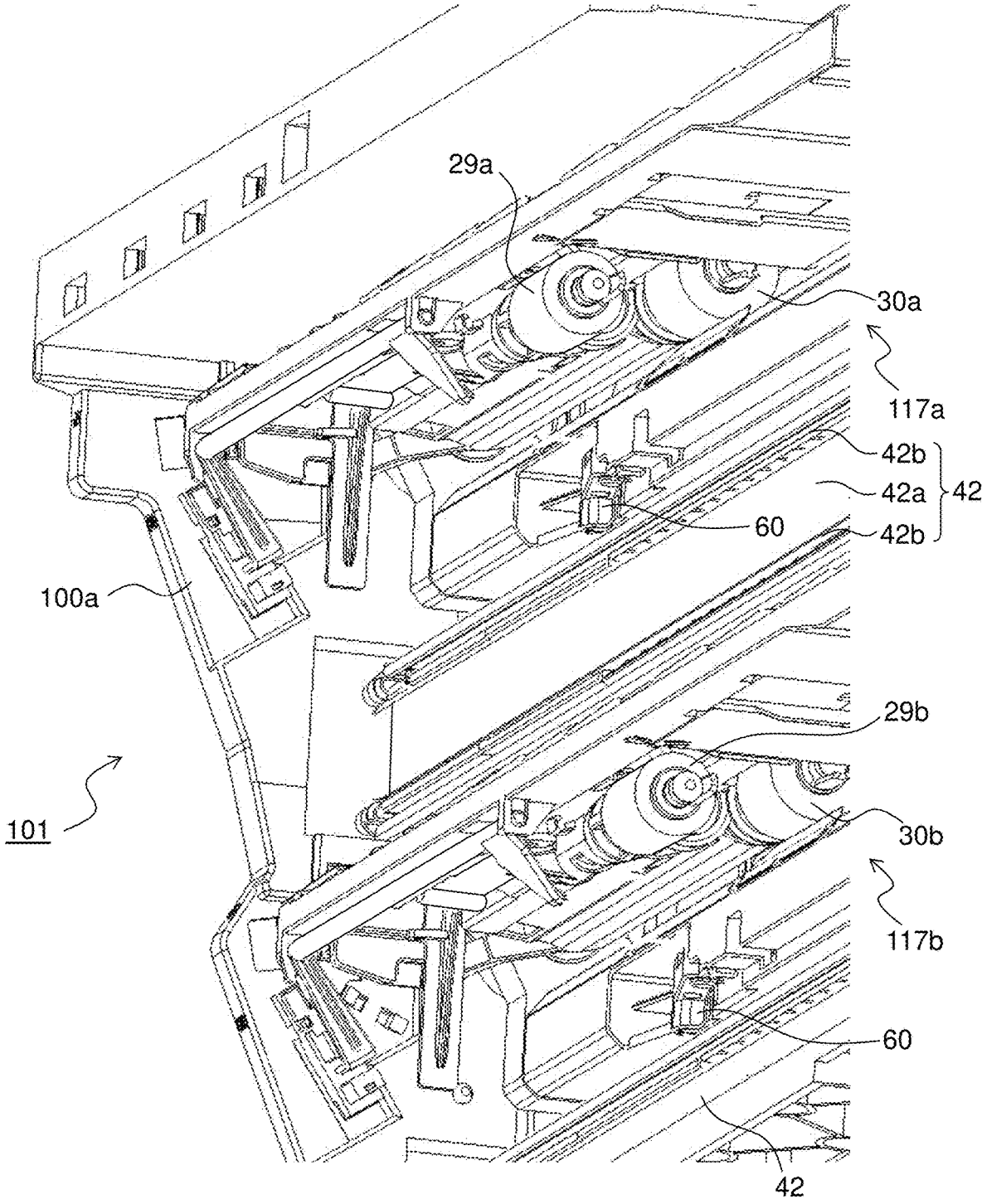
FIG. 3 is a partial perspective view in which an inner side surface of a cassette housing section, the inner side surface being on a downstream side in a paper feeding direction, is viewed in a cassette insertion direction.

FIG. 3 is a partial perspective view in which an inner side surface of the cassette housing section 101, the inner side surface being on a downstream side in the paper feeding direction, is viewed in the cassette insertion direction. As illustrated in FIG. 3, the paper feeding units 117*a* and 117*b* are supported in a manner that can be inserted into and removed from the cassette housing section 101 formed between a pair of side-surface frames 100*a* and 100*b* that are arranged to face each other respectively in the rear and the front of the image forming apparatus 100 (In FIG. 3, the side-surface frame 100*b* in the front is not shown).

A retard contact-and-separation lever 60 is provided below each of the pick-up rollers 29*a* and 29*b*. When the paper feeding cassettes 1*a* and 1*b* are set into the cassette housing section 101, the retard contact-and-separation levers 60 are pressed to allow the retard rollers 31*a* and 31*b* (refer to FIG. 1) to move to a side where the feed rollers 30*a* and 30*b* are present. With this, the feed roller 30*a* and the retard roller 31*a*, and the feed roller 30*b* and the retard roller 31*b* are respectively brought into contact with each other to form paper-feeding roller pairs.

Outer rails 42 are fixed to the side-surface frame 100*a*. The outer rails 42 each include a main-body portion 42*a* that has an elongated flat-plate form, and a pair of bent edges 42*b* that are formed by bending both side edges extending in a longitudinal direction of the main-body portion 42*a*, and has a substantially C-shape in cross section taken in a direction orthogonal to the longitudinal direction. The middle rail 43 (refer to FIG. 6) is inserted to be slidable into each of the outer rails 42. The inner rail 41 (refer to FIG. 2) that is formed on the side surface 10*b* of the cassette base 10 is inserted to be slidable into the middle rail 43.

Figure 4:
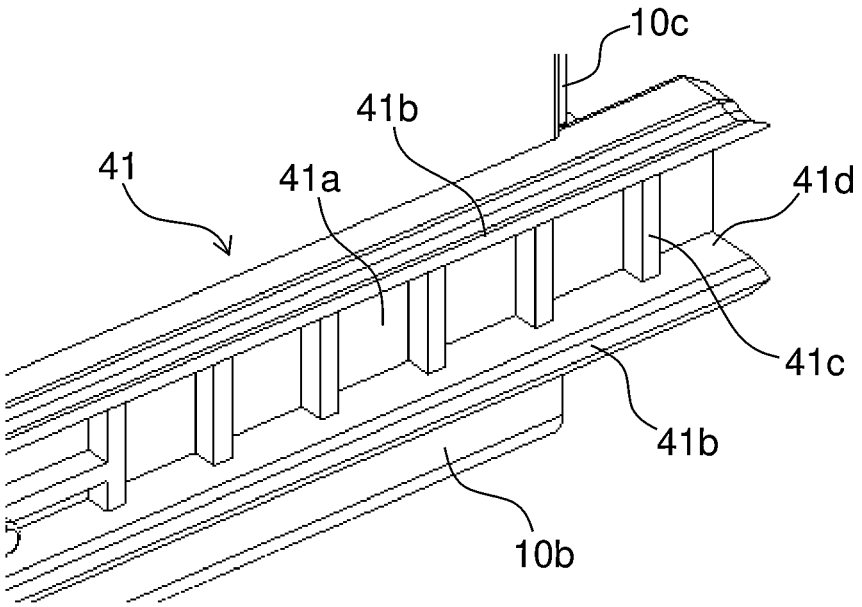
FIG. 4 is a perspective view in which a vicinity of an end portion of an inner rail of the paper feeding cassette, the end portion being on a downstream side in the insertion direction, is viewed from an upstream side in the insertion direction.
Figure 5:
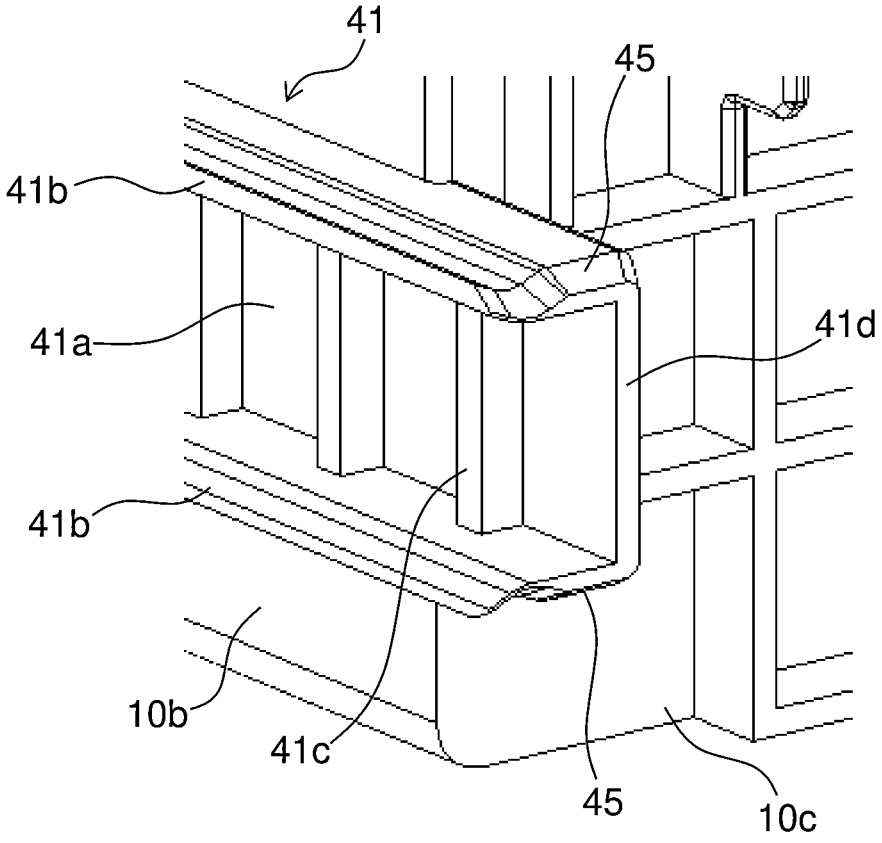
FIG. 5 is a perspective view in which the vicinity of the end portion of the inner rail of the paper feeding cassette, the end portion being on the downstream side in the insertion direction, is viewed from the downstream side in the insertion direction.

FIG. 4 and FIG. 5 are perspective views respectively in which a vicinity of an end portion 41*d* of the inner rail 41, the end portion 41*d* being on a downstream side in the insertion direction, is viewed from an upstream side and the downstream side in the insertion direction. FIG. 4 and FIG. 5 illustrate only the inner rail 41 formed on the side surface 10*b* on one side (a side that is closest to a viewer's perspective in the drawing sheet of FIG. 2) of the cassette base 10 because the inner rail 41 formed on the side surface 10*b* on another side (a side that is furthest from the viewer's perspective in the drawing sheet of FIG. 2) of the cassette base 10 has exactly the same configuration.

The inner rail 41 includes a main-body portion 41*a* that has an elongated flat-plate form and extends in the insertion direction and the removal direction of the paper feeding cassette 1*a*, and a pair of guide ribs 41*b* that protrude outward extending along both side edges in a longitudinal direction of the main-body portion 41*a*. The inner rail 41 has a substantially C-shape in cross section taken in a direction orthogonal to the longitudinal direction, the substantially C-shape being an inverse of shapes of the outer rail 42 and the middle rail 43 (both illustrated in FIG. 6).

In addition, a retaining member 50 (refer to FIG. 2) is attached to the inner rail 41. The retaining member 50 prevents disengagement of the inner rail 41 from the middle rail 43. The retaining member 50 is attached on a downstream side in the insertion direction relative to a central portion in the longitudinal direction of the inner rail 41.

A plurality of (six in this embodiment) reinforcing ribs 41*c* that extend in a vertical direction between the guide ribs 41*b* are formed on a downstream side in the insertion direction relative to the retaining member 50 (right-hand side in FIG. 4). The reinforcing ribs 41*c* are formed to enhance strength of the inner rail 41.

The end portion 41*d* of the inner rail 41, the end portion 41*d* being on the downstream side in the insertion direction, protrudes to a further downstream side in the insertion direction relative to a side surface 10*c* of the cassette base 10, the side surface 10*c* being on the downstream side in the insertion direction. With this, at the time of inserting the paper feeding cassette 1*a* into the cassette housing section 101, the end portion 41*d* of the inner rail 41 is easily positioned relative to the middle rail 43 (refer to FIG. 6) on a side where the cassette housing section 101 is present.

As illustrated in FIG. 5, a pair of inclined portions 45 are formed at the end portion 41*d* of the inner rail 41, the end portion 41*d* being on the downstream side in the insertion direction. The pair of inclined portions 45 are formed respectively of the pair of guide ribs 41*b* of the inner rail 41. More specifically, an inclined portion 45 that is inclined downward in the insertion direction is formed on an upper one of the pair of guide ribs 41*b*, and an inclined portion 45 that is inclined upward in the insertion direction is formed on a lower one of the pair of guide ribs 41*b*. In other words, the pair of inclined portions 45 are inclined to an inner side in a width direction of the inner rail 41 toward the downstream side in the insertion direction.

Figure 6:
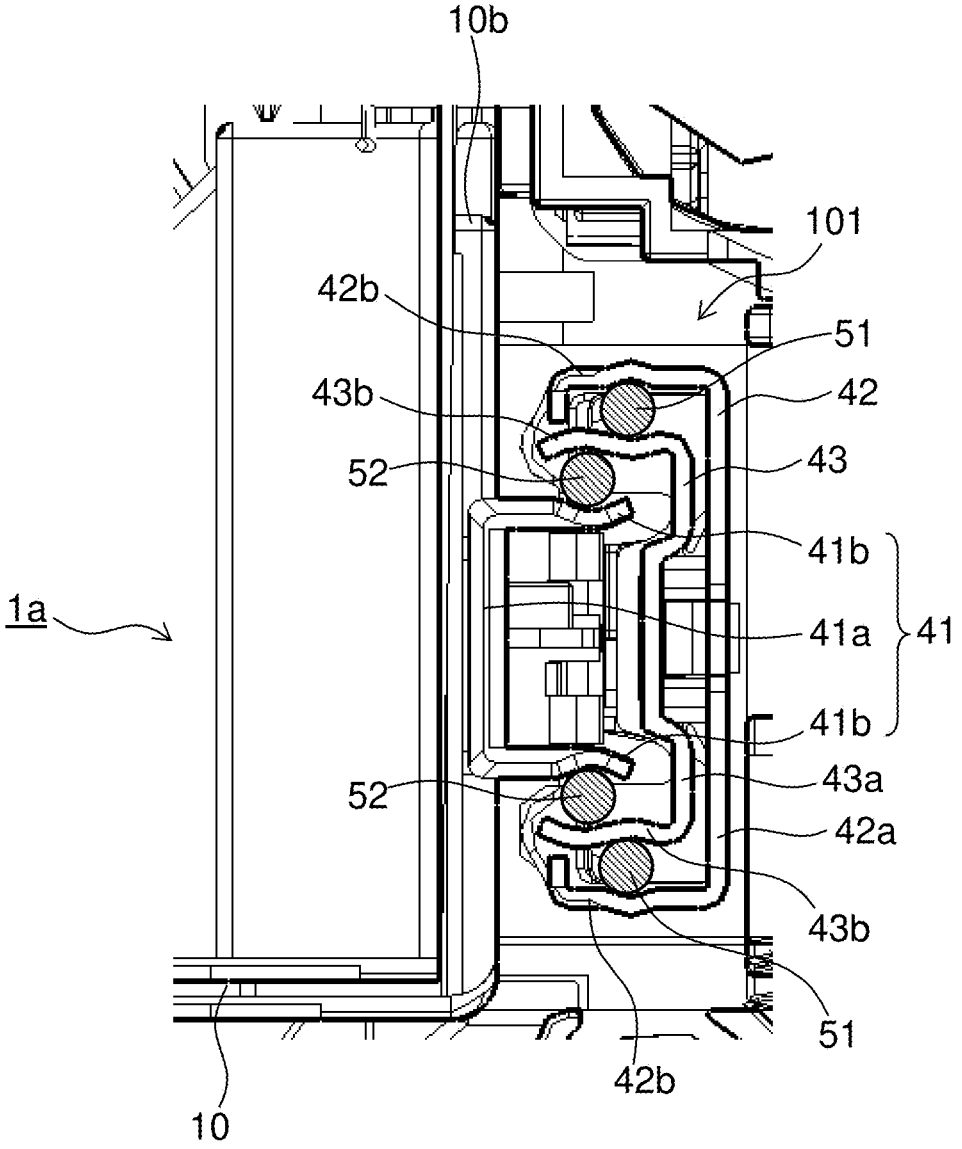
FIG. 6 is a cross-sectional view illustrating a state in which the inner rail of the paper feeding cassette and an outer rail and a middle rail of the cassette housing section are engaged with each other.

FIG. 6 is a cross-sectional view illustrating a state in which the inner rail 41 of the paper feeding cassette 1*a* and the outer rail 42 and the middle rail 43 of the cassette housing section 101 are engaged with each other. In the cassette housing section 101, the outer rails 42 and the middle rails 43 are attached each in a pair to the position that faces the inner rails 41 in a pair formed along the paper feeding cassette 1*a*. The middle rails 43 are made of a metal, and have a shape similar to that of the inner rails 41, specifically, each include a main-body portion 43*a*, and a pair of bent edges 43*b* formed by bending both side edges extending in a longitudinal direction of the main-body portion 43*a*.

A first ball bearing 51 in which a plurality of balls are held to be rollable at a predetermined interval along the longitudinal direction is arranged on an inner side relative to the pair of bent edges 42*b* of the outer rail 42. The first ball bearing 51 faces outer side surfaces of the pair of bent edges 43*b* of the middle rail 43. The balls of the first ball bearing 51 roll between the bent edges 42*b* and the bent edges 43*b*. With this, the middle rail 43 is held to be slidable relative to the outer rail 42.

A second ball bearing 52 in which a plurality of balls are held to be rollable at a predetermined interval along the longitudinal direction is arranged on an inner side relative to the pair of bent edges 43*b* of the middle rail 43. The second ball bearing 52 faces outer side surfaces of the pair of guide ribs 41*b* of the inner rail 41. The balls of the second ball bearing 52 roll between the bent edges 43*b* and the guide ribs 41*b*. With this, the inner rail 41 is held to be slidable relative to the middle rail 43.

When the paper feeding cassette 1*a* is inserted into the cassette housing section 101, the inner rail 41 is inserted into the outer rail 42. Under a state in which the paper feeding cassette 1*a* has been inserted up to a predetermined position (paper feed position) in the cassette housing section 101, the inner rail 41 is completely housed in the middle rail 43, and the middle rail 43 is completely housed in the outer rail 42.

When the paper feeding cassette 1*a* is inserted up to the paper feed position, a pressing rib (not shown) provided to the side surface 10*b* of the cassette base 10 presses the retard contact-and-separation lever 60 (refer to FIG. 3) provided in the cassette housing section 101. When the retard contact-and-separation lever 60 is pressed, the retard roller 31*a* (refer to FIG. 1) is pushed up by a retard contact-and-separation mechanism (not shown), and comes into contact with the feed roller 30*a*.

At a time of replenishing the paper P to the paper feeding cassette 1*a*, the paper feeding cassette 1*a* is drawn out of the cassette housing section 101. Under a state in which the paper feeding cassette 1*a* has been drawn out of the cassette housing section 101 up to a predetermined position (paper replenishment position), the inner rail 41 is completely drawn out of the middle rail 43, and the middle rail 43 is completely drawn out of the outer rail 42.

At this time, the retaining member 50 (refer to FIG. 2) attached to the inner rail 41 and an engaging portion (not shown) of the middle rail 43 are engaged with each other. With this, the inner rail 41 is prevented from dropping off the middle rail 43. In addition, a retaining member (not shown) attached to the middle rail 43 and an engaging portion (not shown) of the outer rail 42 are engaged with each other. With this, the middle rail 43 is prevented from dropping off the outer rail 42.

Meanwhile, at a time of removing the paper feeding unit 117*a* in the cassette housing section 101 for maintenance, and at a time of executing a jam clearing process in the cassette housing section 101, the paper feeding cassette 1*a* is maximally drawn out. In this state, the retaining member 50 and the middle rail 43 are disengaged from each other, and the inner rail 41 is drawn out of the middle rail 43. In this way, the paper feeding cassette 1*a* is removed.

In the configuration of this embodiment, the inner rail 41 is formed integrally with the side surface 10*b* of the cassette base 10. With this, strength of the side surface 10*b* is enhanced, and hence inward sag of the side surface 10*b* is suppressed. Thus, even without use of reinforcing members, the strength of the side surface 10*b* can be secured, and positioning accuracy of the side surface 10*b* is enhanced. In addition, a positional relationship between the paper P to be stored in the cassette base 10 and the paper feeding unit 117*a* on the side where the cassette housing section 101 is present is stabilized. Thus, occurrence of paper-feed failures can be suppressed.

Further, positional accuracy of the pressing rib that is formed on the side surface 10*b* is also enhanced. Thus, when the paper feeding cassette 1*a* is inserted up to the paper feed position, the retard contact-and-separation lever 60 can be reliably pressed by the pressing rib.

Still further, the outer rail 42 and the middle rail 43 that are arranged on the side where the cassette housing section 101 is present are made of a metal. The outer rail 42 and the middle rail 43 are provided respectively with the first ball bearing 51 and the second ball bearing 52. With this, the outer rail 42 and the middle rail 43, and the middle rail 43 and the inner rail 41 smoothly slide. Thus, operations of inserting and drawing out the paper feeding cassette 1*a* can be more smoothly performed than in a configuration in which the resin guide ribs formed on a side where the paper feeding cassette 1*a* is present and a resin guide rail formed on the side where the cassette housing section 101 is present are engaged with and slid relative to each other.

Still further, on a downstream side in the insertion direction relative to the inner rail 41, more specifically, on the downstream side in the insertion direction relative to the retaining member 50, the reinforcing ribs 41*c* that extend in the vertical direction are formed between the guide ribs 41*b*. Thus, the strength of the inner rail 41 can be secured. With this, at the time of replenishing the paper P to the cassette base 10 with the paper feeding cassette 1*a* maximally drawn out, the inner rail 41 can be prevented from being deformed or damaged.

Yet further, the end portion 41*d* of the inner rail 41, the end portion 41*d* being on the downstream side in the insertion direction, is protruded to the further downstream side in the insertion direction relative to the side surface 10*c* of the cassette base 10, the side surface 10*c* being on the downstream side in the insertion direction. With this, the end portion 41*d* of the inner rail 41 and the middle rail 43 are easily positioned relative to each other.

Yet further, the pair of inclined portions 45 are formed at the end portion 41*d* of the inner rail 41, the end portion 41*d* being on the downstream side in the insertion direction. With this, the end portion 41*d* of the inner rail 41 can be easily inserted between the bent edges 43*b* of the middle rail 43. Thus, the paper feeding cassette 1*a* can be easily set into the cassette housing section 101.

Note that, the present disclosure is not limited to the embodiment described hereinabove, and may be variously modified within the gist of the present disclosure. For example, the inner rail 41 need not necessarily be formed at the position close to a bottom surface of the side surface 10*b* as in the embodiment described hereinabove, and the inner rail 41 may be formed at another position on the side surface 10*b*. Further, the reinforcing ribs 41*c* that are formed in the inner rail 41 may be an at least one reinforcing rib 41*c* as long as the strength of the inner rail 41 can be secured.

Still further, the slide rail to be used need not necessarily be constituted by the inner rail 41, the outer rail 42, and the middle rail 43 to extend and retract in three stages as in the embodiment described hereinabove, and may be constituted only by the outer rail 42 and the inner rail 41 to extend and retract in two stages.

The present disclosure is applicable to a sheet storage cassette having a cassette base in which sheet-like recording media are stacked and stored. By application of the present disclosure, strength of side surfaces of the cassette can be enhanced with a simple configuration. As a result, it is possible to provide a sheet feeding device that is capable of reliably positioning the sheet storage cassette relative to a cassette housing section, and to provide an image forming apparatus including the sheet feeding device.

What is claimed is:

1. A sheet feeding device, comprising:

a cassette housing section;

a sheet storage cassette
- that includes a cassette base that is configured to store recording media that have a sheet form, and
- that can be inserted into and removed from the cassette housing section; and a sheet feeding unit
- that is provided in the cassette housing section, and
- that is configured to feed the recording media to be stored in the sheet storage cassette, a pair of fixed-side rails that are made of metal and are attached to the cassette housing section the cassette base being made of a resin, a pair of inner rails that are coupled to the pair of fixed-side rails so that the pair of inner rails are slidable being formed integrally with side surfaces of the cassette base, wherein the pair of fixed-side rails include
- a pair of outer rails that are fixed to inner side surfaces of the cassette housing section, and
- a pair of middle rails that are coupled to the pair of outer rails so that the pair of middle rails are slidable, wherein the pair of inner rails are coupled to the pair of outer rails through intermediation of the pair of middle rails so that the pair of inner rails are slidable, wherein the pair of inner rails each include
- a main-body portion that has a flat-plate form and extends in an insertion direction and a removal direction of the sheet storage cassette, and
- a pair of guide ribs that protrude outward along both side edges extending in a longitudinal direction of the main-body portion, wherein an at least one reinforcing rib that extends in a vertical direction between the pair of guide ribs is formed in the main-body portion, wherein the pair of inner rails each include a retaining member
- that is provided to the main-body portion, and
- that is configured to engage with a corresponding one of the pair of middle rails when the corresponding one of the pair of middle rails is completely drawn out of a corresponding one of the outer rails, thereby to prevent disengagement of the corresponding one of the pair of inner rails from a corresponding one of the pair of fixed-side rails, and wherein the at least one reinforcing rib is formed on a downstream side in the insertion direction of the sheet storage cassette relative to the retaining member.

2. The sheet feeding device according to claim 1, wherein an end portion of each of the pair of inner rails, the end portion being on a downstream side in an insertion direction of the sheet storage cassette, protrudes to a further downstream side in the insertion direction of the sheet storage cassette relative to another side surface of the cassette base, the other side surface being on the downstream side in the insertion direction of the sheet storage cassette.

3. The sheet feeding device according to claim 1, wherein the pair of inner rails are each formed at a position that is closer to a lower end portion of a corresponding one of the side surfaces than to an upper end portion of the corresponding one of the side surfaces.

4. The sheet feeding device according to claim 1, wherein the sheet feeding unit includes a feed roller that is configured to feed the recording media that have a sheet form to be stored in the sheet storage cassette, a retard roller that can be held in contact with and separated from the feed roller, and a retard contact-and-separation lever that is configured to cause the retard roller to be alternately held in contact with and separated from the feed roller, and wherein the retard contact-and-separation lever is pressed with the sheet storage cassette inserted in the cassette housing section.

5. An image forming apparatus, comprising:

the sheet feeding device according to claim 1; and an image forming section that is configured to form images onto the recording media that have been fed by the sheet feeding device according to claim 1.

* * * * *